US009926674B2

(12) United States Patent
Orefice

(10) Patent No.: US 9,926,674 B2
(45) Date of Patent: Mar. 27, 2018

(54) METHOD FOR CONTROLLING A CONSTRUCTION MACHINE, CONTROL SYSTEM FOR A CONSTRUCTION MACHINE, AND CONSTRUCTION MACHINE

(71) Applicant: BOMAG GmbH, Boppard (DE)

(72) Inventor: Michele Orefice, Koblenz (DE)

(73) Assignee: BOMAG GmbH, Boppard (DE)

( * ) Notice: Subject to any disclaimer, the term of this patent is extended or adjusted under 35 U.S.C. 154(b) by 142 days.

(21) Appl. No.: 14/962,020

(22) Filed: Dec. 8, 2015

(65) Prior Publication Data

US 2016/0160452 A1 Jun. 9, 2016

(30) Foreign Application Priority Data

Dec. 8, 2014 (DE) ..... 10 2014 018 082

(51) Int. Cl.
*E01C 23/01* (2006.01)
*E01C 19/00* (2006.01)
*E01C 23/088* (2006.01)

(52) U.S. Cl.
CPC ..... *E01C 19/004* (2013.01); *E01C 23/01* (2013.01); *E01C 23/088* (2013.01)

(58) Field of Classification Search
None
See application file for complete search history.

(56) References Cited

U.S. PATENT DOCUMENTS 4,769,700 A 9/1988 Pryor
6,776,557 B2 * 8/2004 Barnat ..... E01C 19/21 404/101

(Continued)

FOREIGN PATENT DOCUMENTS

DE 102007007970 A1 8/2008
DE 102012021379 A1 4/2014

(Continued)

OTHER PUBLICATIONS

Espacenet, English Machine Translation of Abstract of Publication No. DE102013010298A1, published Dec. 24, 2014, retrieved from http://worldwide.espacenet.com on Feb. 10, 2016 (2 pages).

(Continued)

*Primary Examiner* — Truc M Do
(74) *Attorney, Agent, or Firm* — Wood Herron & Evans LLP

(57) ABSTRACT

The present invention relates to a method for controlling a construction machine which performs a working operation along a working trajectory on a ground depending on at least one operating parameter. A method according to the present invention comprises placing at least one mark, detectable by a sensor device, stationary on the ground in a region which, regarded from at least one position of the construction machine on the working trajectory, is located in the detection region of the sensor device. The mark is detected by the sensor device, resulting in the generation of sensor data which is processed by the data processing device of the construction machine. A control command is generated for the machine control of the construction machine for changing at least one operating parameter of the construction machine.

17 Claims, 6 Drawing Sheets

(56) References Cited

U.S. PATENT DOCUMENTS

| | | | | |
|---|---|---|---|---|
| 7,150,413 | B1 * | 12/2006 | Bricko | B05B 9/0403 239/147 |
| 7,422,391 | B2 * | 9/2008 | Holl | E01C 23/088 299/1.5 |
| 8,113,592 | B2 * | 2/2012 | Busley | B60G 3/01 280/6.157 |
| 8,308,395 | B2 * | 11/2012 | Jurasz | E01C 23/088 404/83 |
| 9,328,467 | B2 * | 5/2016 | Forster | A01B 33/125 |
| 9,562,460 | B2 * | 2/2017 | Arai | E02F 3/764 |
| 9,699,968 | B2 * | 7/2017 | Posselius | A01F 15/08 |
| 2006/0184013 | A1 * | 8/2006 | Emanuel | G01S 5/16 600/426 |
| 2008/0003057 | A1 * | 1/2008 | Hall | E01C 19/22 404/84.1 |
| 2008/0152428 | A1 * | 6/2008 | Berning | E01C 23/088 404/84.1 |
| 2008/0216021 | A1 | 9/2008 | Berning et al. | |
| 2011/0010023 | A1 * | 1/2011 | Kunzig | G01S 5/16 701/2 |
| 2012/0051839 | A1 * | 3/2012 | Begley | E01C 19/48 404/72 |
| 2012/0230548 | A1 * | 9/2012 | Calman | G06K 9/00791 382/104 |
| 2012/0288328 | A1 * | 11/2012 | Minich | E01C 19/1063 404/72 |
| 2013/0076101 | A1 * | 3/2013 | Simon | E01C 23/088 299/39.2 |
| 2013/0283924 | A1 * | 10/2013 | McCullough | G01N 3/00 73/786 |
| 2014/0212217 | A1 | 7/2014 | Wagner et al. | |

FOREIGN PATENT DOCUMENTS

| | | | |
|---|---|---|---|
| DE | 102012024769 | A1 | 6/2014 |
| DE | 102013007061 | A1 | 7/2014 |
| DE | 102013010298 | A1 | 12/2014 |
| EP | 2119832 | A1 | 11/2009 |
| EP | 2246485 | A1 | 11/2010 |
| JP | 07180107 | A | 7/1995 |
| WO | 2006092441 | A1 | 9/2006 |

OTHER PUBLICATIONS

Japanese Patent Office, English Translation of Patent Abstracts of Japan, Japanese Publication No. 07180107A, published Jul. 18, 1995 (2 pages).

Espacenet, English Machine Translation of EP2119832A1, published Nov. 18, 2009, retrieved from http://worldwide.espacenet.com (1 page).

Espacenet, English Machine Translation of EP2246485A1, published Nov. 3, 2010, retrieved from http://worldwide.espacenet.com (1 page).

Espacenet, English Machine Translation of DE102012021379A1, published Apr. 30, 2014, retrieved from http://worldwide.espacenet.com (1 page).

Espacenet, English Machine Translation of DE102012024769A1, published Jun. 18, 2014, retrieved from http://worldwide.espacenet.com (1 page).

* cited by examiner

METHOD FOR CONTROLLING A CONSTRUCTION MACHINE, CONTROL SYSTEM FOR A CONSTRUCTION MACHINE, AND CONSTRUCTION MACHINE

FIELD OF THE INVENTION

The present invention relates to a method for controlling a construction machine which performs a working operation along a working trajectory on a ground depending on at least one operating parameter. For performing the method, the construction machine comprises an electronic control unit having a machine control and a data processing device as well as a sensor device having a suitable detection region. The present invention also relates to a control system for a construction machine of the above described type as well as to a construction machine of the above described type.

BACKGROUND OF THE INVENTION

Construction machines moving on a working trajectory or a working curve during operation, the approximate course of which is known prior to the start of operation, are used in different fields of construction, such as earth-moving construction or road construction. This may, for example, be the course of a road or be predetermined at least partially by obstacles such as buildings, trees, etc. In this case, the term working trajectory thus refers to a planned route the construction machine is to move along during the respective operation and along which it ideally moves during operation. For example, it is often times known for construction machines used in road construction that their working trajectory follows the planned or actual course of a road. Typical cases here are the milling track of a ground milling machine, particularly a road milling machine, a recycler, a stabilizer or a surface miner, the road surface applied by a road paver, or a lane processed by a grader. Thus, the working trajectory refers to the path which is to be processed by the respective construction machine and along which said machine moves during operation.

In many cases, operation of such a construction machine depends on at least one operating parameter comprising different setpoint values for different points of the working trajectory. Such a working parameter may be defined by the adjustment height of a working device of such a construction machine, by the working intensity or also by the working width, for example. The term operating parameter thus refers particularly to a parameter by means of which the respective working device of the construction machine is set.

In this context, it has been common that the monitoring and control of the at least one operating parameter is performed by the operator of the construction machine. Said operator does not only have to regularly check the operation with respect to the direction and work result, but usually also needs to enter the relevant control commands with respect to the working direction and the work result. Usually, this is performed by means of a console mounted on the construction machine, particularly on the operator platform of the construction machine. However, sometimes this type of control places high demands to the construction machine operator during operation as he simultaneously needs to monitor the travel movement and the operation of the working device and partly even further functions such as loading of a transport vehicle, monitoring the filling level of a bunker, etc., and ensuring a reliable operation.

One example of a construction machine which is used along a working trajectory and the operation of which depends on at least one working parameter is a ground milling machine. Ground milling machines serve for removing the surface of ground material, for example, for milling off road surfaces. To that end, ground milling machines comprise as a special working device a rotating milling drum which is equipped with milling chisels and which is immersed into the ground and guided therethrough by the ground milling machine for milling off ground material, thus producing a milling track. Such a ground milling machine has been described in DE 10 2012 021 379 A1, for example.

For example, one operating parameter essential to the working operation of a ground milling machine is the milling depth indicating how deep the milling drum mills off the ground surface in the vertical direction relative to the original surface of the ground. Depending on the respective target of the respective operation, however, situations may occur in which the milling depth varies over the working trajectory. Examples of such a variation of the milling depth may be milling a ramp between the milling bed and the non-processed ground, on which the ground milling machine may, for example, move out of the milling track, obstacles in the milling path, for example, storm drains, which are not to be milled over, etc.

Further examples of construction machines also moving over comparatively long sections along a working trajectory during operation are, in particular, road construction machines such as road pavers (as described in DE 10 2013 007 061 A1) or recyclers/stabilizers (as described in DE 10 2012 024 769 A1), or also earth-moving machines such as graders or cable laying machines (as described in EP 2246485 A1, for example).

Thus, said construction machines have in common that, in regular operation, they often times move along a path or working trajectory along which the working process is performed. It is known and common for such machines and working operations that marks are manually placed on the ground along the working trajectory prior to the actual working operation, which represent working instructions to the operator of the respective ground processing machine. For example, in this context it is known for a ground milling machine, particularly a road milling machine, that the desired milling depths are sprayed onto the ground as numbers. Then, the operator of the machine has to continuously check during operation whether marks are placed on the ground and, if so, which changes are required for the operation of the ground processing machine.

SUMMARY OF THE INVENTION

Based on this overall unsatisfactory situation, the object underlying the present invention is to increase the ease of use during operation of generic construction machines, particularly ground processing machines, which perform ground processing operations over relatively large distances along a working trajectory.

One aspect of the present invention lies with relieving the operator from the detection and processing of marks placed on the ground during the working operation, i.e., while the construction machine moves along the working trajectory. To that end, the method according to the present invention provides that in a first step at least one mark detectable by a sensor device is, at least temporarily until it is detected, placed stationary to the ground in a region which would, regarded from at least one position of the construction machine on the working trajectory, be located in the detection region of the sensor device. Thus, said process is effected prior to the start of the working operation, in which, for example, a person inspects the path to be processed and places corresponding marks on the ground that are adapted to the sensor system. The at least one mark basically encodes a control command for the construction machine, as will be explained in more detail below. Subsequently, in a second step, said mark is detected by the sensor device, resulting in the generation of sensor data. This is followed by a third step in which the sensor data is processed, and thus interpreted, by the data processing device of the construction machine. Finally, in the fourth step, a control command for manipulating at least one operating parameter of the construction machine is generated by the data processing device for the machine control of the construction machine based on the detected mark, and is transferred to the corresponding device which the control command is related to. As a result, by means of the present method the operator is relieved from the task of controlling the at least one operating parameter during the ongoing working process, so that he may better focus on his other tasks.

According to one embodiment of the present invention, the control of the at least one operating parameter of the construction machine during working operation is thus effected via one or multiple marks which are placed outside the construction machine along the working trajectory, and which are detected by the sensor device. Placing the mark stationary on the ground serves the purpose that the mark is to be used for controlling the operating parameter of the construction machine at or from a certain point on the working trajectory. Said point on the working trajectory may be determined, for example, by the position of the construction machine relative to the placed mark, or it may alternatively correspond to the point on the working trajectory from which the mark is detected for the first time by the sensor device of the construction machine while the construction machine follows the working trajectory (initial detection). A local or timely delay of the control of the operating parameter relative to the initial detection is conceivable as well. The at least one mark may thus be placed flexible in terms of the location within a certain frame, specifically depending also on the extension of the detection region to be explained in greater detail below. The time of placement is also relatively flexible since the mark may be placed in front of the construction machine by a third person either several days prior to the start of operation or only just before the construction machines arrives at the respective point on the working trajectory or even during working operation. An essential point is that the mark is placed such that it can be detected by the sensor device during working operation.

The method according to the present invention may be used for controlling most different operating parameters. The type of operating parameters actually applied depends essentially on the type of construction machine used and the working operation performed by said machine. The at least one operating parameter is at least an adjustment height of the height-adjustable element on the construction machine. Thus, the method according to the present invention is used for controlling height adjustment of an element of the construction machine, for example, a height-adjustable working device or a height-adjustable running gear. Such lifting columns, via which running gears of the construction machine are connected to the machine frame, particularly, for example, road milling machines, are known from the prior art. In this refinement, the control command is thus directed to the regulation of the height position of the height adjustable element. This enables regulation of the milling depth in known ground milling machines, for example. Further applications may include the height adjustment of a working device relative to the machine frame, for example, the height adjustment and/or inclination of a shield of a grader, a screed of a road paver or the milling device of a stabilizer/recycler.

In order that the method according to the present invention can be performed, it is important that the mark is reliably detected by the sensor device. The specific configuration of the sensor device of the construction machine and the mark used in connection with the method thus need to be adapted to one another. This is, for example, the case if, on the one hand, the used mark can actually be detected by the sensor device of the construction machine, and, on the other hand, the information of the mark destined for controlling the construction machine, such as a value for the operating parameter, is encoded in the mark such that said information is also encoded in the sensor data after detecting the mark by the sensor device. However, encoding the information in the mark and in the sensor data may vary from one another. Here, the term encoding is to be understood in a broader sense as any type of symbolization of information. For example, if the mark is a mark in which an operating parameter is encoded optically, for example, in the form of a number, the sensor device of the construction machine should accordingly comprise an optical sensor.

Interplay between mark and sensor device for indicating and detecting the at least one operating parameter may also vary. In this context, a construction machine having a sensor device comprising at least one optoelectronic sensor and at least one camera is preferably used. In this case, the sensor data comprise a camera image and the above-described method step of processing the sensor data comprises processing the camera image and interpreting the mark in the camera image by means of an image processing program. Advantages of using a camera as a sensor and image processing as a method step are that optical marks can mostly also be recognized by humans comparatively well and systems of optical information codes, such as letters and common symbols, comprehensible to humans are comparatively wide-spread in use. Thus, as marks for the method according to the present invention particularly marks may be used which on the one hand can be interpreted by the sensor system of the construction machine and which on the other hand are easily comprehensible to a human. This way, errors when placing the marks may comparatively reliably be avoided.

Such optical marks may, for example, be numbers, letters or other characters. Then, the method according to the present invention preferably includes a method step for processing the sensor data by means of an optical character recognition (OCR) and particularly a hand writing recognition (HWR) by means of an image processing program. Hand-written marks provide the advantage that they can be placed quickly and flexible in location. Almost any surface is suitable for receiving a hand-written mark when using a suitable writing device, for example, a color spray can.

A higher information density may be obtained if, when performing the method according to the present invention, a mark is used which is an optical binary code, particularly a bar code or QR code, which is interpreted by a corresponding image processing program. The advantages of optical binary codes include that they may easily be generated by means of commercially available devices, that they have been used successfully in industrial applications for decades and that they are particularly highly resistant to errors. This way, a particularly high input reliability may be achieved for the method according to the present invention. In particular, such optical binary codes are suitable for use in connection with signs on which the binary codes are printed before use. During operation, the signs, which are, for example, pre-produced, having the binary codes may then be placed along the working trajectory in the detection region of the sensor device of the construction machine.

Further, the object of the present invention is achieved by a control system for a construction machine for performing the method according to the present invention, which moves along a working trajectory on a ground during working operation. The control system includes on the construction machine an electronic control unit having a data processing device and a machine control, as well as a sensor device having a detection region. In addition, the control system comprises at least one mark, which is at least temporarily placed stationary on the ground. It will be understood that the mark should be placed on the ground at least until it is detected by the construction machine. The mark is placed on the ground such that it gets into the detection region of the sensor device when the construction machine moves along the working trajectory. The data processing device is configured such that it detects the at least one mark by means of the sensor device when the at least one mark is located in the detection region of the sensor device, and that it may generate a control command for the machine control from the at least one mark and transfer said command to the machine control.

Thus, the control system for a construction machine comprises at least, on the one hand, elements arranged on the construction machine and, on the other hand, elements at least temporarily placed on the ground stationary. Thus, the relative position of the construction machine to the ground changes during operation along the working trajectory, but the relative position of the mark to the ground is at least temporarily stationary. This does thus not mean that it is generally impossible to move the mark relative to the ground. It is essential that the placed mark shall remain on the ground until it is detected by the sensor device. Once the mark has been passed by the detection region of the sensor device, the mark may stay there if another operation of the construction machine along the working trajectory is desired, or it may be collected or even destroyed.

The specific configuration of the at least one mark may vary as well. In this regard, generally anything may be considered that is, on the one hand, suitable for encoding corresponding information and, on the other hand, can be detected and then evaluated by the respectively used sensor device. Marks, signs, labels, flags, etc., directly placed on the ground by means of a color spray can or a pencil are particularly suitable for marking purposes.

The functional interplay of the elements of the control system arranged on the construction machine results in a data processing chain. Said data processing chain reaches from the sensor device of the construction machine, by means of which sensor data is generated, via the data processing device to the machine control. From a functional point of view, the data processing device and the machine control are each part of the electronic control unit (ECU) of the construction machine. The object of the machine control is to generate control commands for individual controllable machine components, such as a height adjustment device, particularly in the form of lifting columns, and to transfer said commands to them. The object of the data processing device lies with the processing of the sensor data and generation of a control command to the machine control. The sensor device, the machine control and the data processing device are each functional units, which may be integrated in one part, although this is not obligatory. As a result, the machine control and the data processing device may be implemented as different units communicating with each other. It is likewise conceivable that the data processing device and the sensor device of the construction machine are implemented as one common unit, for example, in a so-called smart camera. Besides the control commands for the machine control generated by the data processing device, other ways of inputting said information to the machine control, for example, manually, are possible. In this case, the programming of the machine control for the priority of the various inputs is decisive. For example, for safety means, the machine control may be programmed such that a change of an operating parameter generated by the data processing device is subordinate to a change of the operating parameter input by the machine operator. This way it is ensured that the machine operator always has full control of the machine. Such prioritization of the control commands may for example be effected depending on a priority hierarchy between the various input options or depending on the timely sequence of the control commands.

Various embodiments are conceivable for the specific configuration of the sensor device, which are included in the scope of the present invention. For example, the sensor device may comprise one single sensor only, or it may comprise multiple sensors. Using multiple sensors at once may enlarge the detection region of the sensor device, for example. It is also possible that the sensor device comprises multiple sensors of different types at once in order to enable a greater detection spectrum. Thus, in practice optical and/or RFID technology based marks may be considered alternatively or additionally. This way, the control system according to the present invention may be used with a particularly great spectrum of different marks.

In a preferred embodiment, the control system for a construction machine is characterized in that the sensor device comprises at least one camera, particularly a color camera, infrared camera or smart camera with an optoelectronic sensor, and that at least one of the at least one mark includes a visual, optically detectable mark. Such a mark may, for example, be a color mark sprayed on the ground or also a sign or a board. In the simplest case, even a label with a mark written on it may be used. The specific type of mark used is obviously determined by the specific configuration of the sensor device and the types of marks it can detect.

In another preferred embodiment, the control system for a construction machine is characterized in that the sensor device comprises at least one radio receiver, particularly an RFID reading device, and that at least one mark comprises a radio transmitter, particularly an RFID transponder. Said technology is particularly well suitable for the present application case in construction operation, since it is comparatively robust and particularly resistant to pollution.

Thus, the configuration of the sensor device is essential for implementing the present invention. Besides the detection principle underlying the sensor device, in particular, the configuration of the detection region plays an essential role. The detection region of the sensor device refers to the region within which the sensor device is capable of actually detecting the objects generally detectable by means of the sensor technology used. In other words, the detection region of the sensor device refers to the visual range of the sensor, such as the vision cone of a CCD camera. The detection region may have most different shapes depending on the used sensor. Besides the above-described cone-shaped extension of the detection region, also a spherical or a hemispherical extension of the detection region (e.g., for radio receivers/transmitters) or a line-shaped configuration are conceivable. Depending on the used sensor technology, the detection region is limited by a certain detection range from the sensor device. The specific detection range is determined by the combination of the used sensor and the used mark. For example, in the case of an optical mark, the detection range may vary depending on the size of the mark and the resolution of the used camera. Comparable variations result in the case of a combination of radio receivers and radio transmitters having a different signal strength, for example.

In a preferred refinement of the control system according to the present invention, at least two prebuilt marks are summed up in a type case system, and the at least one mark consists of a combination of at least two prebuilt marks, which are elements of said type case system. Preferably, each of said prebuilt marks can be detected by the sensor device both individually and in combination with further prebuilt marks of the type case system. Such a type case system provides the advantage that, on the one hand, prebuilt marks can be used (as described above with respect to optical binary codes) and, on the other hand, a greater variety of different input options may be achieved by means of the combination of multiple marks. Besides the above-described binary codes, a type case system is particularly suitable in combination with the above-described RFID transponders. In this case, the type case system may particularly comprise multiple types of marks, each encoding different values for an operating parameter. For example, for adjusting the milling depth of a ground milling machine, a type case system of RFID transponders may be used, where the individual mark types represent a milling depth of 10 cm, 5 cm or 1 cm. A milling depth of 17 cm could be achieved by placing a 10 cm mark, a 5 cm mark as well as two 1 cm marks. Said system may of course be adapted to other operating parameters and value ranges.

Furthermore, the object is achieved also by a construction machine configured to move along a working trajectory on a ground, and which comprises an electronic control unit having a machine control and a data processing device as well as a sensor device having a detection region. For this purpose, the construction machine is preferably configured for performing the method according to the present invention.

The advantages of the present invention will particularly be obvious if the construction machine comprises at least one running gear with a controllable height adjustment device, which running gear is height-adjustable relative to a machine frame of the construction machine, and, in particular, if the construction machine comprises at least two height-adjustable running gears each having a controllable height adjustment device. Such type of height-adjustable running gears are particularly used in ground milling machines, for example, such as described in DE 10 2013 010 298, to which reference is hereby made. In such ground milling machines, often times the milling depth, i.e., the degree of engaging the ground by the milling device in vertical direction, is controlled by an adjustment of the height-adjustable running gear. Particularly, in big construction projects, such ground milling machines often times move over comparatively large distances along a planned working path, the working trajectory, and mill off the ground along said working trajectory in the desired width. Application of the above disclosed method is particularly suitable for such machines. Specifically, the working trajectory is inspected prior to the working process by a user, for example, in order to detect ground obstacles or desired straight and curved sections. The user places a mark on the ground reflecting the desired change at least in places where changes occur with respect to the milling depth (for example, milling start, milling end, obstacle, etc.) and/or with respect to the configuration of the working trajectory or the desired working path (for example, from a straight section into a curved section or changes of the curve radius). Of course, it is also possible to place a mark at places where a change of the current control commands is not desired. Then, the mark has a kind of confirmation or safety function. The specific configuration of the mark has been described above and essentially depends on the type of sensor system used as well as on the type of transformation of the acquired sensor data into a control command. The data processing device is configured such that it generates a control command for the machine control depending on the mark detected by the sensor device, which command, for example, includes instructions to adjust the milling depth of the construction machine by means of the controllable height adjustment device of the height-adjustable running gear, particularly by means of the controllable height-adjustment device of the at least two height-adjustable running gears.

According to one embodiment of the present invention, the construction machine comprises at least one height-adjustable working device having a controllable height adjustment device, wherein the data processing device is configured for generating a control command for the machine control depending on the mark detected by the sensor device, which command includes instructions to adjust the working height of the working device by means of the controllable height adjustment device of the height-adjustable working device. Such a working device may, for example, be the milling drum of a ground milling machine or the screed of a road paver. A change of the working height of the working device may result in that the construction machine effectively does not carry out a working performance. This may particularly be the case if the contact of the working device to the ground is interrupted by the change of the working height. Usually, the working device of a construction machine has an effective operational altitude. This refers to an interval for the working height of the working device within which the working device may perform work on the ground.

In a preferred refinement, the construction machine is an earth-moving or road construction machine, particularly a road milling machine, a recycler/stabilizer, a grader, a cable laying machine or a road paver.

BRIEF DESCRIPTION OF THE DRAWINGS

The present invention will be schematically described in more detail below with reference to the exemplary embodiments shown in the figures. Like components are indicated by like reference numerals in the figures. In the schematic figures.

DETAILED DESCRIPTION OF THE INVENTION

Figure 1:
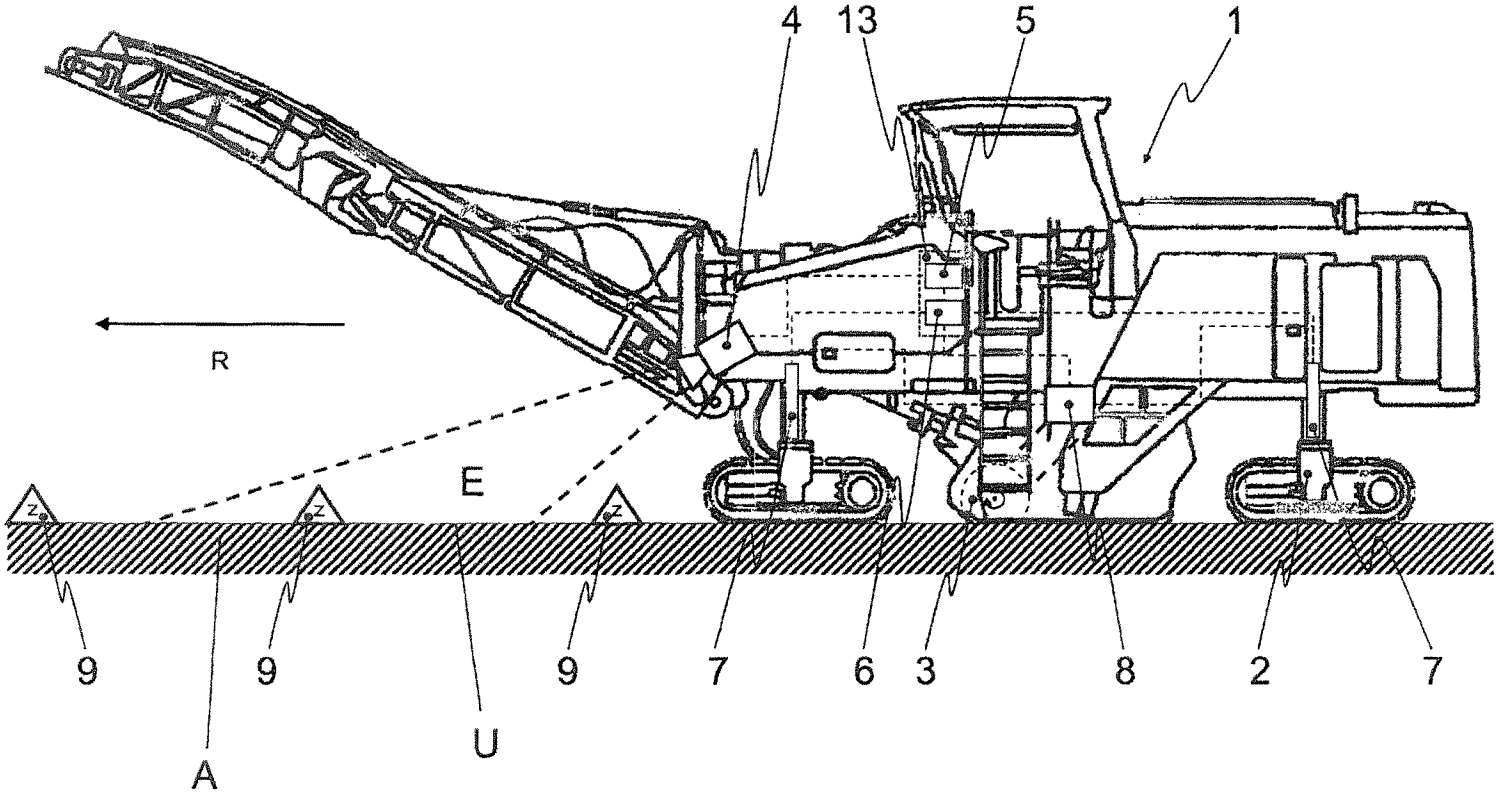
FIG. 1 shows a road milling machine having a sensor device in a side view.

FIGS. 1 to 4 illustrate the general structure of a construction machine according to an exemplary embodiment of the present invention and the functionality of the control system according to the exemplary embodiment. The construction machine 1 performs a working operation along a working trajectory A on a ground U. During said process, it moves in working direction R by means of multiple running gears 2. Desired values for an operating parameter of the construction machine are provided on the marks 9. A sensor device 4 is arranged on the respective construction machine, which device is suitable for detecting the marks 9. The sensor device 4 is connected to a data processing device 5, wherein this hereinafter refers to a connection for transferring data. Specifically, the connection between the sensor device 4 and the data processing device 5 is particularly configured for transferring sensor data generated by the sensor device. Furthermore, the data processing device 5 is connected to the machine control 6. The connection between the data processing device 5 and the machine control 6 is particularly configured for transferring control commands. The data processing device 5 and the machine control 6 are commonly comprised in an electronic control unit 13. The machine control 6 in turn is connected to the height adjustment device 7 of the running gear and, if required, to the height adjustment device 8 of the working device. The connections between the machine control 6 and the height adjustment devices 7, 8 are also particularly configured for transmitting control commands.

During the working process, the construction machine 1 follows the working trajectory A in working direction R, with the marks 9 one after the other in the moving direction of the construction machine getting into the detection region E of the sensor device 4 of the construction machine 1 and being detected by the sensor device 4.

Figure 2:
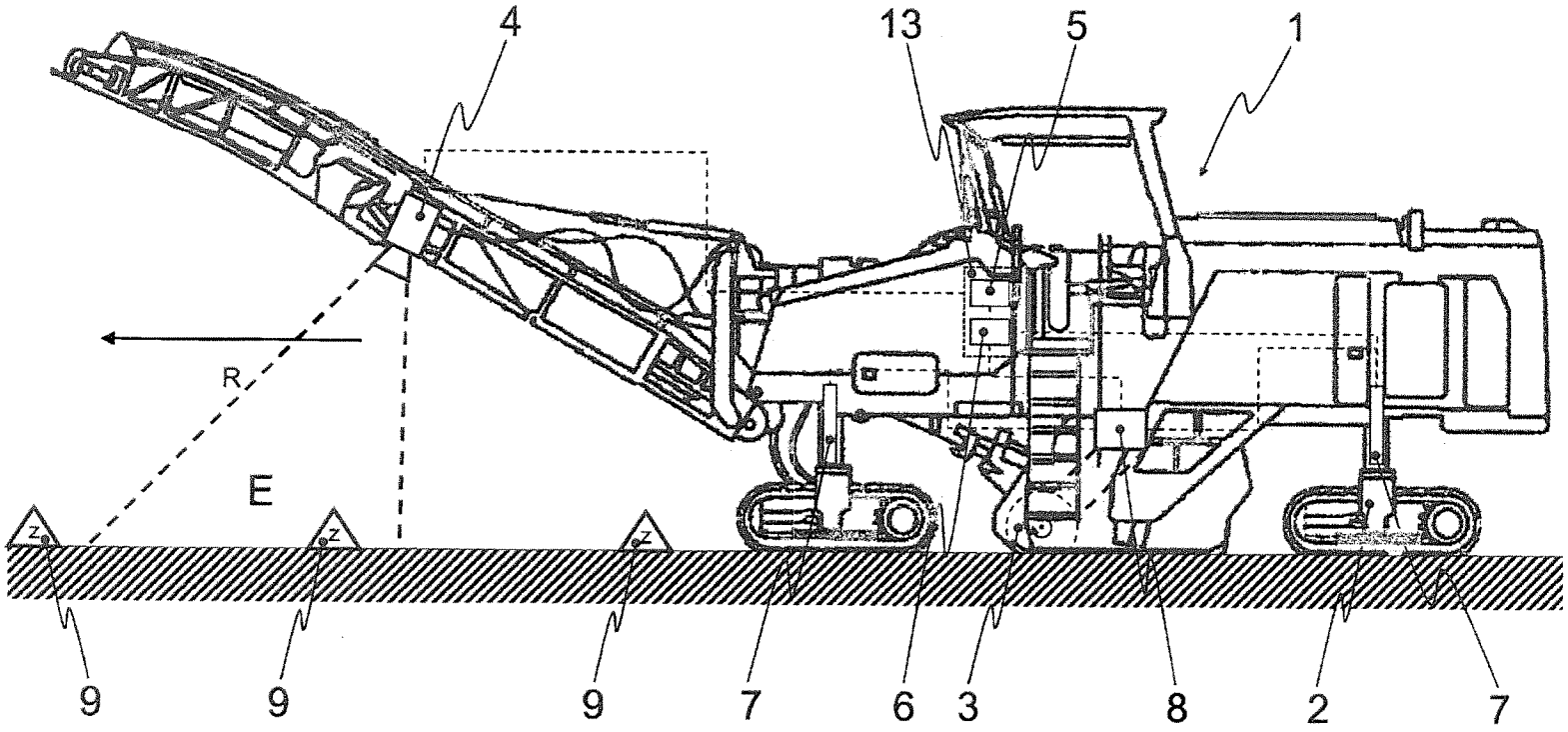
FIG. 2 shows a road milling machine having a sensor device, with the sensor device being arranged on an alternative position, also in a side view.
Figure 3:
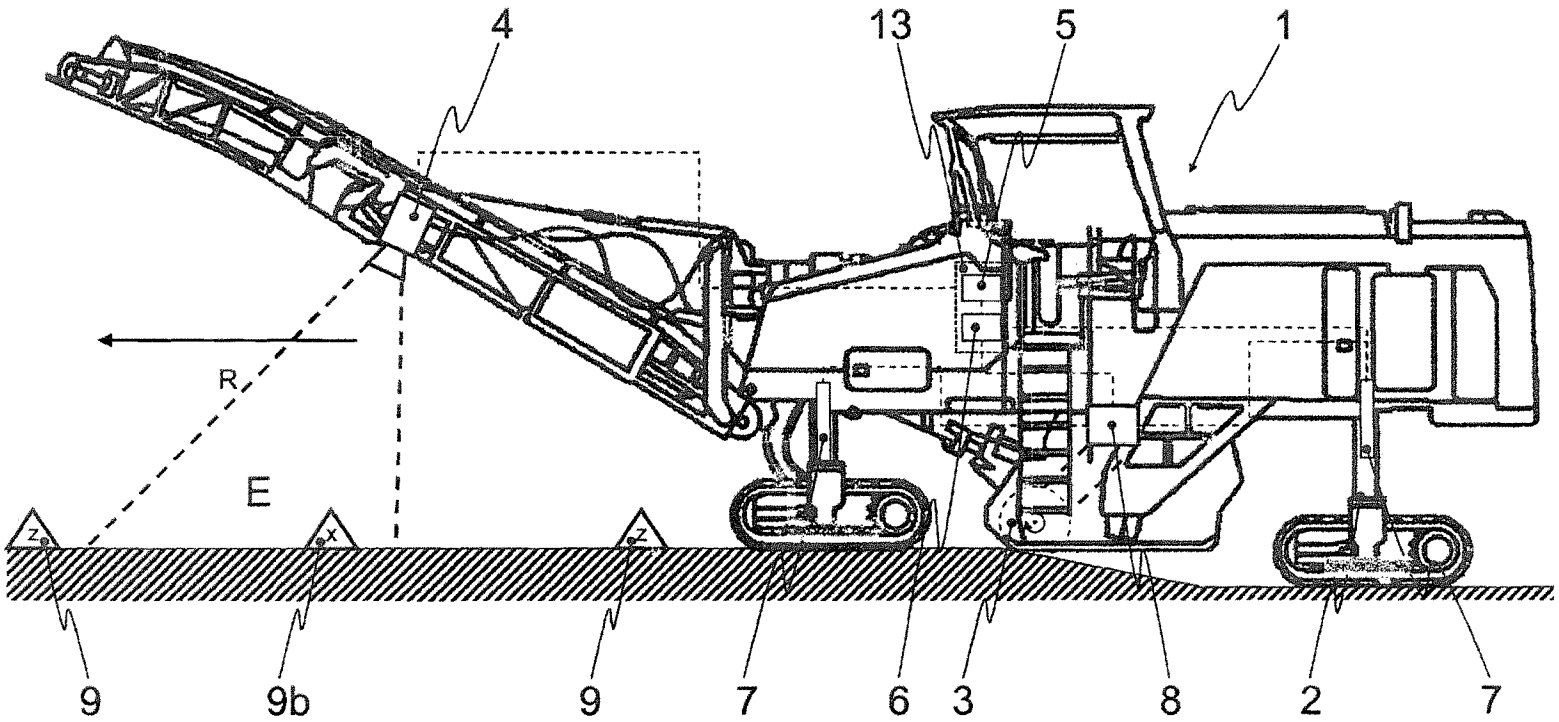
FIG. 3 shows a road milling machine having a sensor device, which mills a ramp into the ground.

FIGS. 1 to 3 show a construction machine 1 in each case configured as a road milling machine, where the milling depth of the working device 3 (milling drum) is adjustable via the height adjustment devices 7 (lifting columns) of the running gears 2. As an alternative, it may also be provided that the working device 3 is height-adjustable relative to the machine frame of the road milling machine via the height adjustment device 8 and the machine control 6 thus sends a command to the height adjustment device 8 of the working device 3, which command includes instructions for adjusting the working height or position of the working device 3 or at least parts thereof, for example, in the case of an inclination or a lateral displacement of the working device, relative to the machine frame. This may also include a coordinated height adjustment of all present lifting columns.

In FIG. 1, the sensor device 4 is mounted, as regarded in the working direction, on the front machine frame of the road milling machine and offset to the left side on the machine frame. The detection region E thus extends in the working direction of the road milling machine to the front and detects particularly also a region arranged laterally, specifically left, next to the track to be produced. The detection region thus moves over a strip of the ground running adjacent to the working trajectory during operation.

FIG. 2 shows an alternative attachment of the sensor device 4 to the conveyor of the road milling machine. In said exemplary embodiment, the sensor device 4 is attached to the bottom side of the conveyor approximately centrally and thus detects a region located in the working track. In operation, the marks 9 located on the ground are thus first moved over by the detection region E of the sensor device 4 and subsequently moved over by the milling device 3 of the road milling device and destroyed. As a result, marks 9 will not remain on the ground after the working process.

FIG. 3 illustrates as an exemplary working process depending on operating parameters the milling of a ramp by means of the road milling machine. Milling a ramp may be achieved by the continuous reduction of the milling depth of the road milling machine, the milling depth in this example is thus the operating parameter in the sense of the described invention. In the example, the milling depth is indirectly proportional to the working height of the milling drum of the road milling machine. The continuous reduction of the milling depth is therefore achieved by means of a continuous height adjustment of the working device 3 by means of the height adjustment device 8 in the manner described above. Said process is triggered in that the sensor device 4 detects a mark **9*b* in which the instructions for generating the ramp are encoded. Specifically, the sensor device 4 is a camera here. During operation, said camera constantly generates sensor data in the form of camera pictures. Said camera pictures are each transformed into digital image data in the optoelectronic sensor of the camera, and the digital image data are transmitted to the data processing device 5**. In order to be able to process the sensor data, the data processing device comprises an image processing module.

When the mark **9*b* is detected by the sensor device 4, the camera image shows mark 9*b*. Correspondingly, a representation of the mark 9*b* can be found in the resulting digital image data. Now, the image data showing the mark 9*b* are processed by means of the image processing module. Here, a multitude of different methods may be used. A first step of the processing of image data may, for example, consist in the identification of mark 9*b* as an actual mark in the image data. Said identification may be effected by means of a pattern comparison with known patterns, for example. After identification of the mark 9*b* in the image, the image section showing the mark 9*b* may be further processed, for example. In the case that mark 9*b*** is a character on a sign, for example, an optical character recognition (OCR) may be used.

The result of the processing of sensor data, i.e., of the digital image data in the present example, is a provision for changing the operating parameter. This may, for example, be an absolute value for the operating parameter, i.e., a value that the operating value shall be set to, or a relative value for the operating parameter, i.e., a value by which the operating parameter shall be increased or reduced. It may also be a more complex provision such as the change of the operating parameter according to a certain calculation specification over a certain period of time. One example of such a calculation specification is a continuous reduction of the operating parameter over a certain time period.

In the example shown in FIG. 3, mark **9*b* encodes the provision for continuously reducing the operating parameter "milling depth" over a certain time period such that a ramp develops in the working track of the road milling machine. Once interpretation of the sensor data by means of the data processing device 5 has been performed, the data processing device 5 generates a control command which includes instructions for changing the operating parameter "milling depth" according to the provision encoded in the mark. Said control command is transferred to the machine control 6**. In the example, the control command includes the instruction for continuously reducing the milling depth.

The control command is processed in the machine control 6. Processing of the control command includes translation of the control command into individual instructions for the actuators of the controllable elements of the construction machine 1. In the present case, the processing of the control command includes the transformation of the control command into instructions for the height adjustment device 7 of the running gears 2, respectively the height adjustment device 8 of the working device 3. The machine control transmits said instructions as control commands to the respective actuators. The actuators in the height adjustment devices 7, 8 implement said control commands and thus change the milling depth of the construction machine over a desired time period by the desired value.

Figure 4:
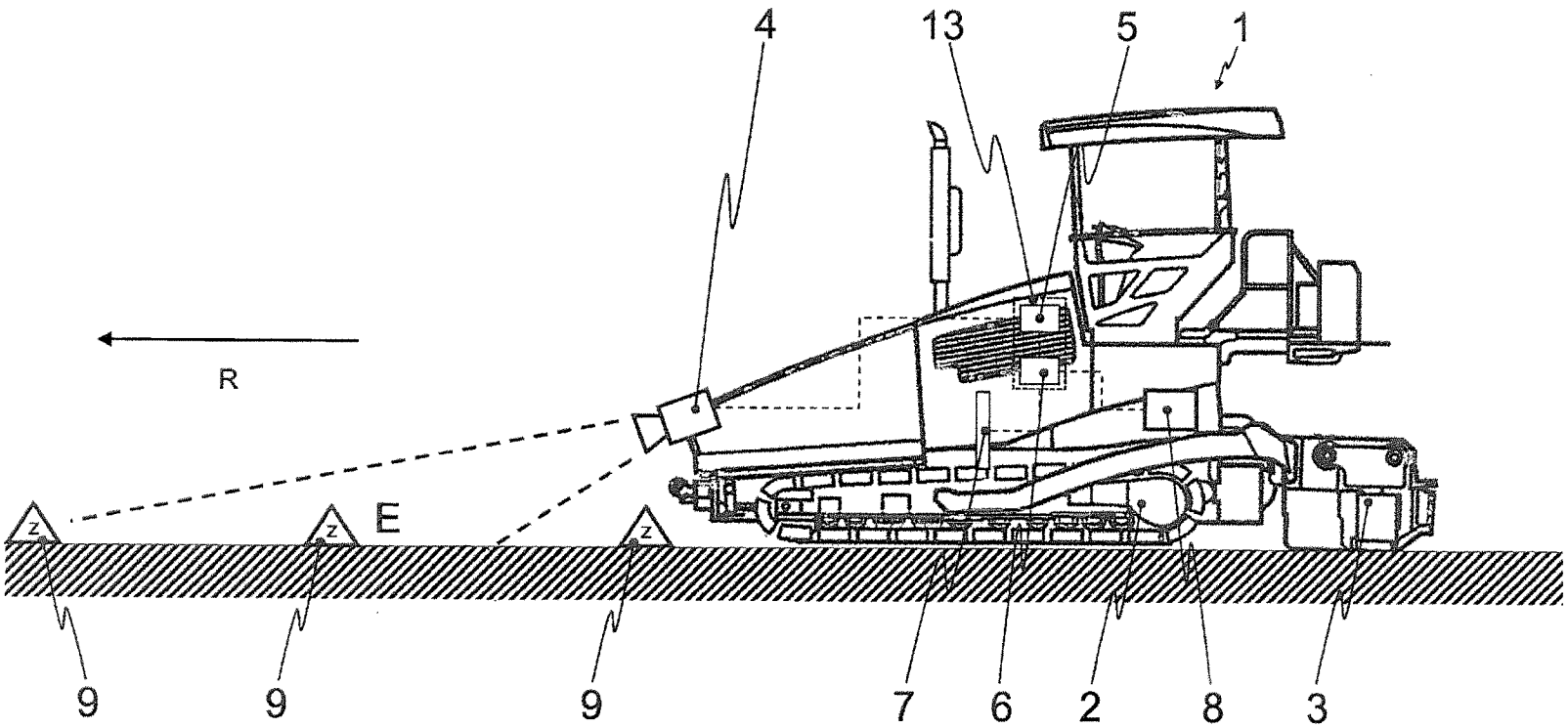
FIG. 4 shows a road paver having a sensor device in a side view.

FIG. 4 shows as a further example of a construction machine for performing the method according to the present invention a road paver, which is also equipped with a sensor device 4 implemented as a camera. In this case, the sensor device 4 is arranged such that it is arranged laterally, specifically left, next to a receiving bunker of the road paver, and that it detects the ground region in the detection region E in front of the road paver. Typical machine functions that can be encoded via marks 9 are working width, curve or straight drive and/or thickness of the road surface applied, for example.

Figure 5:
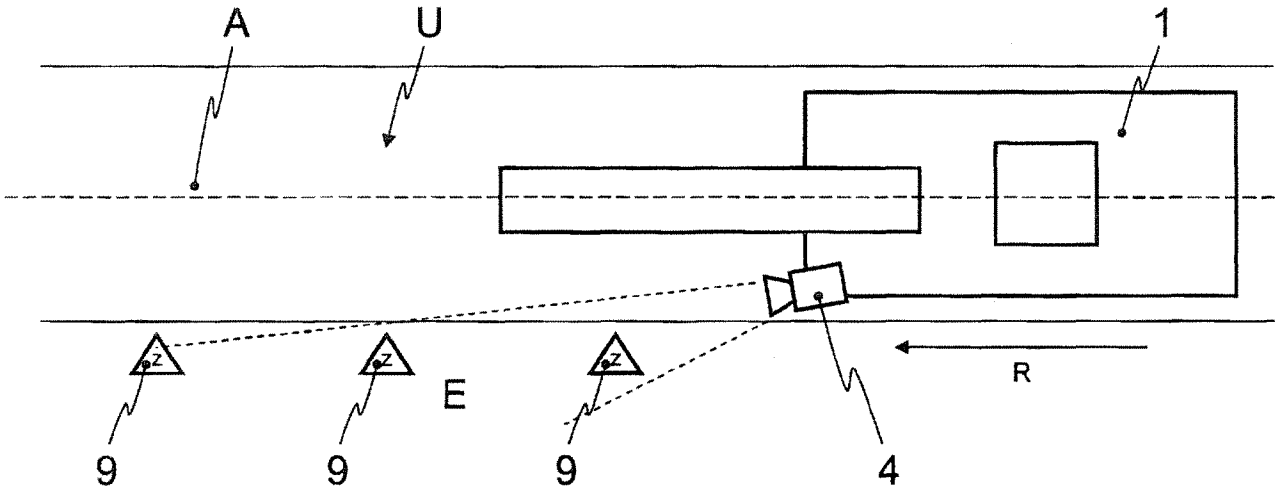
FIG. 5 shows a road milling machine having a sensor device moving along a working trajectory in a top view.
Figure 6:
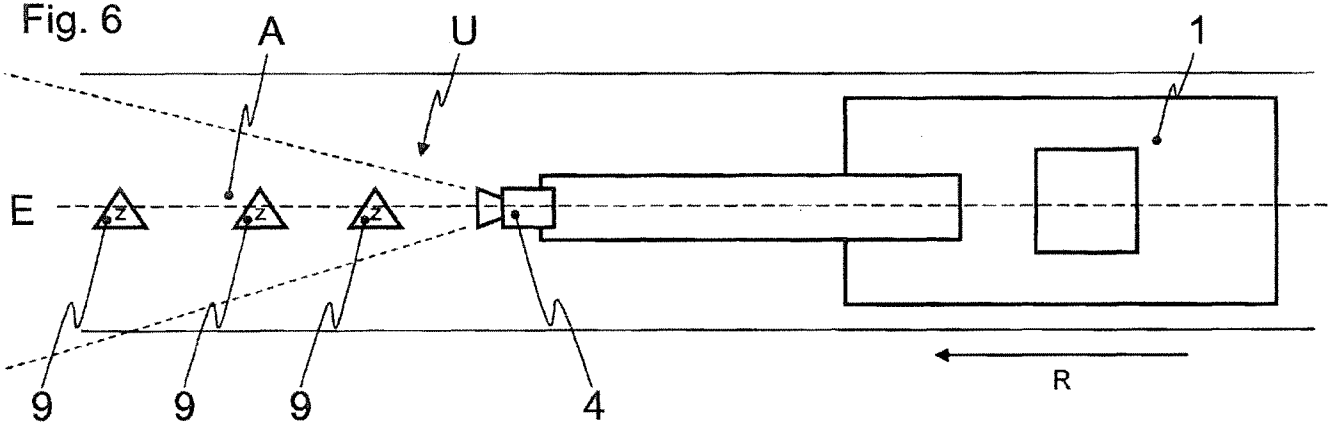
FIG. 6 shows a road milling machine having a sensor device moving along a working trajectory, with the sensor device being arranged in an alternative position to FIG. 5, also in a side view.

FIGS. 5 and 6 serve for the further explanation of the principle underlying the present invention. In the exemplary embodiment, both figures refer to a road milling machine, which is shown very schematically having a conveyor, operator platform and machine frame. Inter alia, the differences between the two exemplary embodiments are the different arrangement of the sensor device 4 relative to the machine frame and the detection region of the sensor device 4, which in the present case is a camera. In FIG. 5, the camera is arranged non-centrally in the front region of the road milling machine 1 and is mounted on the road milling machine 1 so it is pivoted towards one side, specifically the left side. The detection region thus extends into a region located adjacent to the milling track in direction of the working direction R. The sensor device thus checks a strip located next to the milling track, respectively the working trajectory, for the presence of marks 9 during the working process. The marks 9 have correspondingly been placed on the ground next to the working track of the construction machine 1. According to FIG. 6, the detection region of the sensor device 4, which in this case is placed centrally with respect to the width of the machine, runs centrally and extends to the ground located directly in front of the road milling machine in the working direction, which ground will be moved over by the road milling machine during operation. Correspondingly, the marks are thus also placed in the "future" milling bed and will be destroyed when run over by the road milling machine.

Figure 7:
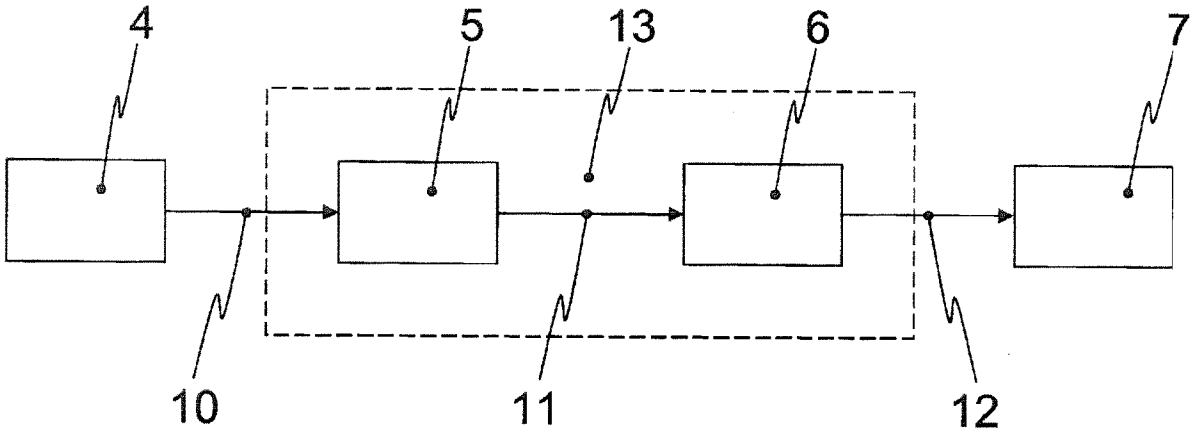
FIG. 7 a flow chart of a method according to the present invention.

Finally, FIG. 7 illustrates schematically an exemplary course of the method according to the present invention. By means of the detection of the ground, the sensor device 4 generates sensor data 10 which are transmitted to the data processing device 5. From a functional point of view, the data processing device 5 is part of the electronic control unit (ECU) 13. The data processing device 5 processes the sensor data 10, recognizes if a mark placed on the ground has been detected by the sensor device, and thereupon generates a control command 11 for the machine control 6 depending on the detected mark. From a functional point of view, the machine control 6 is also part of the ECU 13. The machine control 6 processes the control command 11 and generates the corresponding partial control commands 12 for the actuators of the adjustment devices 7 of the adjustable elements of the construction machine, such as running gears or working devices. Subsequently, the machine control 6 transmits said commands to the corresponding actuators.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A method for controlling a construction machine which comprises at least one height-adjustable element and at least one controllable height adjustment device for the at least one height-adjustable element, the height-adjustable element being a working device or a running gear which performs a working operation depending on at least one operating parameter along a working trajectory (A) on a ground (U), the construction machine comprising an electronic control unit having a machine control and a data processing device and further comprising a sensor device with a detection region (E), wherein the method comprises:

a) placing at least one mark detectable by the sensor device stationary on the ground (U) in a region which is regarded from at least one position of the construction machine on the working trajectory (A), located in the detection region (E) of the sensor device;

b) detecting the at least one mark by the sensor device of the construction machine and generating sensor data;

c) processing the sensor data by the data processing device;

d) generating a control command for the machine control based on the mark;

e) transferring the control command to the at least one controllable height adjustment device for the at least one height-adjustable element; and f) adjusting the height of the at least one height-adjustable element by the at least one controllable height adjustment device for the at least one height-adjustable element.

2. The method according to claim 1, the sensor device comprising at least one optoelectronic sensor and at least one camera, and the sensor data comprising a camera picture, wherein method step c) comprises the processing of the camera image and the interpretation of the representation of the at least one mark in the camera image by an image processing program.

3. The method according to claim 2, wherein method step c) comprises at least one of the following processing operations by the image processing program:

an optical character recognition (OCR), or reading out an optical binary code.

4. A control system for performing a method according to claim 1 for a construction machine which moves along a working trajectory (A) on a ground (U), comprising an electronic control unit of the construction machine having a machine control and a data processing device, and further comprising a sensor device of the construction machine having a detection region (E) and at least one mark, which is placed stationary on the ground (U), wherein the data processing device is configured to detect the at least one mark via the sensor device when the at least one mark is located in the detection region (E) of the sensor device, and that the data processing device is further configured to generate a control command for the machine control from the at least one mark and to transfer said command to the machine control.

5. The control system for a construction machine according to claim 4, wherein at least one of the following feature combinations applies to the sensor device and the mark:

the sensor device comprises at least one camera, an infrared camera or a smart camera, having an optoelectronic sensor, and the at least one mark comprises an optical mark which is sprayed on the ground (U) or attached to a sign, or the sensor device comprises at least one radio receiver, and the at least one mark comprises a radio transponder.

6. The control system for a construction machine according to claim 4, wherein at least two prebuilt marks are comprised in a type case system and in that the at least one mark consists of a combination of at least two prebuilt marks which are part of the type case system.

7. A construction machine configured to move along a working trajectory (A) on a ground (U), comprising an electronic control unit having a machine control and a data processing device, and further comprising a sensor device with a detection region (E), wherein the construction machine is configured using a control system according to claim 4.

8. The construction machine according to claim 7, comprising at least one height-adjustable running gear with a controllable height adjustment device, wherein the data processing device is configured to generate a control command for the machine control depending on the mark detected by the sensor device, which command includes instructions to adjust the level of the construction machine via the controllable height adjustment device of the height-adjustable running gear.

9. The construction machine according to claim 7, comprising at least one height-adjustable working device having a controllable height adjustment device, wherein the data processing device is configured to generate a control command for the machine control depending on the mark detected by the sensor device, which command includes instructions to adjust the working height of the working device via the controllable height adjustment device of the height-adjustable working device.

10. The construction machine according to claim 7, wherein the construction machine is an earth-moving construction machine or a road construction machine, a road milling machine, a recycler/stabilizer, a grader, a cable laying machine or a road paver.

11. The method according to claim 3, wherein the optical character recognition (OCR) comprises a hand writing recognition (HWR).

12. The method according to claim 3, wherein the optical binary code comprises a bar code or QR code.

13. The control system for a construction machine according to claim 5, wherein the camera comprises a color camera.

14. The control system for a construction machine according to claim 5, wherein the sensor device comprises an RFID reading device.

15. The control system for a construction machine according to claim 5, wherein the at least one mark comprises an RFID transponder.

16. The construction machine of claim 8, comprising at least two height-adjustable running gears with a controllable height adjustment device.

17. The construction machine according to claim 16, wherein the command includes instructions to adjust the level of the construction machine via the controllable height adjustment device of the at least two height-adjustable running gears.

* * * * *